US012349852B2

(12) United States Patent
Khizar et al.

(10) Patent No.: US 12,349,852 B2
(45) **Date of Patent: *Jul. 8, 2025**

(54) DISH DRYING SYSTEM WITH WATER HARVESTING HYBRID NANOMATERIAL

(71) Applicant: WHIRLPOOL CORPORATION, Benton Harbor, MI (US)

(72) Inventors: Muhammad Khizar, St. Joseph, MI (US); Mateusz Michal Wolowicz, Olawa County (PL); Philip J. Czarnecki, Saugatuck, MI (US)

(73) Assignee: Whirlpool Corporation

( * ) Notice: Subject to any disclaimer, the term of this patent is extended or adjusted under 35 U.S.C. 154(b) by 148 days.

This patent is subject to a terminal disclaimer.

(21) Appl. No.: 17/502,225

(22) Filed: Oct. 15, 2021

(65) Prior Publication Data

US 2023/0123693 A1 Apr. 20, 2023

(51) Int. Cl.
*A47L 15/48* (2006.01)
*A47L 15/00* (2006.01)
*A47L 15/42* (2006.01)

(52) U.S. Cl.
CPC ..... *A47L 15/481* (2013.01); *A47L 15/0034* (2013.01); *A47L 15/4223* (2013.01); *A47L 15/488* (2013.01); *A47L 2401/19* (2013.01); *A47L 2501/22* (2013.01); *A47L 2501/30* (2013.01)

(58) Field of Classification Search
CPC ..... A47L 15/481
See application file for complete search history.

(56) References Cited

U.S. PATENT DOCUMENTS

| | | | | |
|---|---|---|---|---|
| 9,492,057 | B2 | 11/2016 | Dreossi et al. | |
| 10,730,008 | B2 | 8/2020 | Schaumann et al. | |
| 11,812,911 | B2 * | 11/2023 | Czarnecki | A47L 15/0042 |
| 2015/0216390 | A1 * | 8/2015 | Kumar | A47L 15/4285 134/108 |

(Continued)

FOREIGN PATENT DOCUMENTS

| | | | |
|---|---|---|---|
| DE | 3830664 | A1 * | 3/1990 |
| DE | 19818812 | A1 | 10/1999 |

(Continued)

OTHER PUBLICATIONS

EP2574267—Machine Translation (Year: 2013).*
DE3830664—Machine Translation (Year: 1990).*

*Primary Examiner* — Marc Lorenzi
(74) *Attorney, Agent, or Firm* — Brooks Kushman P.C.

(57) ABSTRACT

A dishwasher includes a tub with an outlet for humid air to flow out from the tub, and an inlet for dry air to flow into the tub; and a drying system with an air circuit and an adsorbent component disposed between an air inlet and an air outlet in the air circuit. The adsorbent component includes a water harvesting nanomaterial for absorbing water from the humid air and releasing water upon regeneration. During a drying cycle, the air circuit draws humid air from the tub such that the adsorbent component absorbs moisture from the humid air to form a dry air stream, and during a subsequent wash cycle, the air circuit is blocked from receiving air flow such that latent heat can be transferred to the adsorbent component via conduction, convection, or both, to regenerate the water harvesting nanomaterial.

5 Claims, 3 Drawing Sheets

(56) References Cited

U.S. PATENT DOCUMENTS

2017/0319045 A1* 11/2017 Wu ..... A47L 15/488

FOREIGN PATENT DOCUMENTS

| | | | | |
|---|---|---|---|---|
| DE | 102012223485 | A1 | 6/2014 | |
| DE | 102013204003 | A1 | 9/2014 | |
| EP | 2353487 | A2 | 8/2011 | |
| EP | 2072109 | B1 | 1/2012 | |
| EP | 2574267 | B1 | 4/2014 | |
| EP | 3019067 | B1 | 11/2018 | |
| EP | 4124278 | A1 | 1/2023 | |
| WO | WO-2013097975 | A1 * | 7/2013 | ..... A47L 15/0034 |
| WO | 2015/003931 | A1 | 1/2015 | |

* cited by examiner

DISH DRYING SYSTEM WITH WATER HARVESTING HYBRID NANOMATERIAL

TECHNICAL FIELD

The present application is directed to a drying system for a home appliance, and more particularly, improved regeneration of adsorbent material in the drying system.

BACKGROUND

Dishwashers have been and are becoming more and more standard in homes. Dishwashers may provide for automatic washing of a load, including for example, dishes and other cookware arranged on various racks within the tub of the dishwasher. Existing dishwashers include various conventional drying systems (e.g., with condensers, vents, fans, etc.) for drying the load. However, the conventional drying systems may have certain performance drawbacks including, for example, not completely drying the load, taking a longer time for drying, or allowing humid air to condense back onto the dishes and cookware within the tub. Thus, not only do consumers place importance on the speed and performance of the dishwasher, but energy efficiency of the drying capabilities is an important feature of dishwashers as well.

SUMMARY

According to one or more embodiments, a dishwasher includes a housing having walls defining a tub with a tub outlet for humid air to flow out from the tub, and a tub inlet for dry air to flow into the tub; and a drying system. The drying system includes an air circuit having an air inlet for flowing humid air into the air circuit, and an air outlet connected to the tub inlet to flow dried air to the tub, and an adsorbent component. The adsorbent component is disposed between the air inlet and the air outlet within the air circuit, with the adsorbent component including a water harvesting nanomaterial for absorbing water from the humid air and releasing water upon regeneration. During a drying cycle, the air circuit draws humid air from the tub via the air inlet such that the adsorbent component absorbs moisture from the humid air to form a dry air stream, and during a subsequent wash cycle, the air circuit is blocked from receiving air flow from the tub such that latent heat can be transferred to the adsorbent component via conduction, convection, or both, to regenerate the water harvesting nanomaterial.

According to at least one embodiment, the water harvesting may be is a reactive oxygen species having an average pore size of 5 nm to 100 nm. In one or more embodiments, the water harvesting nanomaterial may have a regeneration temperature of 30 to 65 degrees C. In certain embodiments, the water harvesting nanomaterial may be a sponge-like nanomaterial. In at least one embodiment, during the drying cycle, the dry air stream may be returned to the tub via the tub inlet. In other embodiments, the housing may include a door assembly having an open position for providing access to the tub, a closed position for sealing the tub, and an intermediate position for venting the tub during a portion of the drying cycle. In further embodiments, during the portion of the drying cycle, the dry air stream may be vented via the air outlet to an external environment, along with the humid air from the tub. In some embodiments, the door assembly may be opened to the intermediate position based on an interior humidity of the tub reaching a predetermined threshold. In at least one embodiment, during the subsequent wash cycle, water released from the water harvesting nanomaterial during regeneration may be drained from the air circuit into the tub for draining with wash water.

According to one or more embodiments, a dishwasher includes a housing having walls defining a tub with an outlet for humid air to flow out from the tub, an inlet for dry air to flow into the tub, and a door assembly for closing the tub to an external environment. The dishwasher also includes a drying system fluidly connected to the tub, with the drying system having an air circuit having an air inlet for flowing the humid air into the air circuit, and an air outlet connected to the tub inlet to flow the dry air to the tub, and an adsorbent component disposed between the air inlet and the air outlet within the air circuit. The adsorbent component includes a water harvesting nanomaterial for absorbing water from the humid air and releasing water upon regeneration. During a first portion of a drying cycle, the door assembly is closed and the air circuit draws humid air from the tub via the air inlet such that the adsorbent component absorbs moisture from the humid air to form a dry air stream, and during a subsequent wash cycle, the air circuit is blocked from receiving air flow from the tub such that latent heat can be transferred to the adsorbent component via conduction, convection, or both, to regenerate the water harvesting nanomaterial.

According to at least one embodiment, the dry air may be flowed to the tub via the inlet during the first portion of the drying cycle. In at least one embodiment, during a second portion of the drying cycle, after the first portion, the door assembly may be opened such that the dry air and humid air from the tub exits the tub to the external environment. In further embodiments, the second portion of the drying cycle may be based on an interior humidity of the tub reaching a predetermined threshold. In at least one embodiment, the water harvesting nanomaterial may be a reactive oxygen species having an average pore size of 5 nm to 100 nm. In one or more embodiments, the water harvesting nanomaterial may have a regeneration temperature of 30 to 65 degrees C. In certain embodiments, the water harvesting nanomaterial may be a sponge-like nanomaterial. In at least one embodiment, during the subsequent wash cycle, water released from the water harvesting nanomaterial during regeneration may be drained from the air circuit into the tub for draining with wash water.

According to one or more embodiments, a method of operating a dishwasher includes running a wash cycle to clean dishes loaded into a tub, initiating a dry cycle to supply hot air to the tub to dry the dishes and form hot humid air, and flowing the hot humid air into a drying system to contact an adsorbent material in an air circuit to absorb moisture from the hot humid air and form a dry air stream for supply to the tub and a hydrated adsorbent material. The method further includes, during a subsequent wash cycle, regenerating the adsorbent material via latent heat generated during the subsequent wash cycle and transferred conductively through a wall of the tub, convectively through the air circuit, or both.

In at least one embodiment, initiating the dry cycle may include initiating a first portion of the dry cycle where a door assembly of the dishwasher is closed such that the tub is sealed from an external environment. In at least one further embodiment, initiating the dry cycle may include, upon an interior humidity of the tub reaching a predetermined threshold, initiating a second portion of the dry cycle, after the first portion, where the door assembly is open such that the tub is exposed to the external environment for the dry air stream to be vented to the external environment.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

According to one or more embodiments, a dishwasher includes a drying system to draw moisture out of the humid air being circulated through the dishwasher and return dry air back to the tub to facilitate drying of dishes in the tub of the dishwasher. The drying system includes an adsorbent material along the air circuit which can be regenerated (i.e., release water from) the adsorbent material, with the drained water being returned to the tub for draining at the end of the wash cycle. The adsorbent material is blocked from airflow during the wash cycle, and is open to allow airflow from the tub during the drying cycle. The adsorbent material is a sponge-like water harvesting nanomaterial reactive oxygen species, which can be regenerated at temperatures of as low as 30 to 50 degrees C., in certain embodiments. The adsorbent material is regenerated using latent heat within the dishwasher (e.g., from the tub generated during a wash cycle, which may be conducted from the tub to the compartment and/or cartridge of the adsorbent material).

Conventional desiccants raise issues with drying plastic articles in dishwashers. For example, conventional dishwashers may use excessive heat to generate relatively more hot air for drying via high power heating elements. Another conventional approach was to use longer drying time of the articles, however plastic articles may not show improvement in drying performance. Thus, both the conventional approaches may increase the power burden and cycle time of the dishwasher. Furthermore, conventional desiccants, such as zeolite-based desiccants, have limited water adsorption at low humidity, and exhibit high adsorption enthalpies of more than 70 kJ mol, requiring temperatures above 150° C. for the desorption, making regeneration of the desiccant energy consumptive and increase the power demand of the dying system. As such, the presently proposed drying system and adsorbent material allows for absorption of excessive moisture from the dishwasher with energy efficient regeneration.

Figure 1:
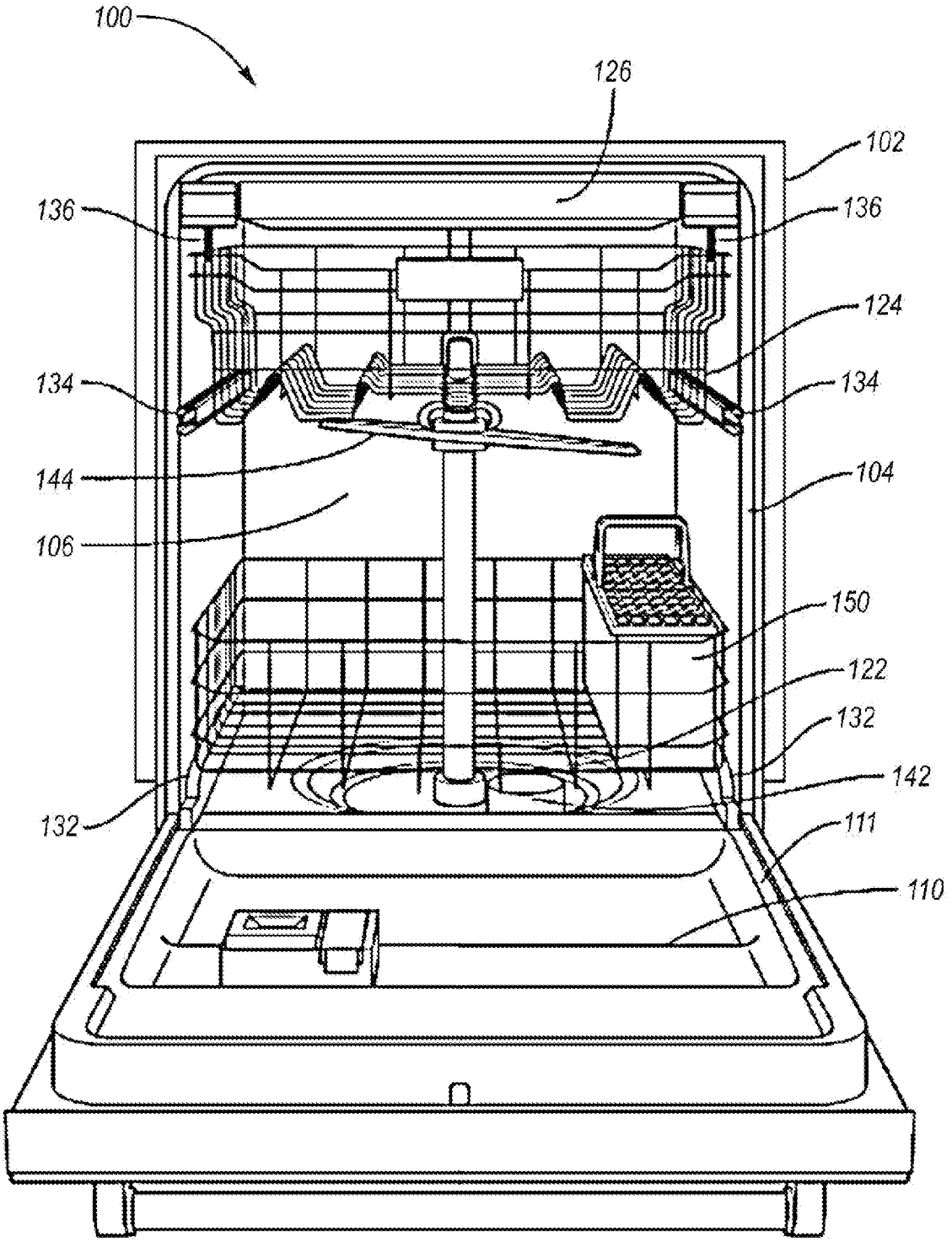
FIG. 1 is a front view of a dishwasher, according to an embodiment.

FIG. 1 illustrates an example front perspective view of a dishwasher 100 in accordance with one example embodiment. The dishwasher 100 may be an automated appliance configured to clean kitchen equipment placed within the dishwasher 100. The kitchen equipment may include tableware such as, for example, dishes, glassware, cutlery and other utensils, as well as food preparation equipment such as, for example, pots and pans, slicers, presses, and peelers. To perform the cleaning, the kitchen equipment is placed on racks 122, 124 inside a tub 104 of the dishwasher 100. A door assembly 110 is closed to form a watertight seal with the tub 104 from an exterior environment. Washing liquid and rinsing liquid is propelled from jets onto the kitchen equipment to clean dirt, grease, and other contaminants off the kitchen equipment. Though the examples described herein are generally related to in-home and personal use dishwashers, the same concepts may be applicable to commercial dishwashers as well.

The dishwasher 100 may include a frame 102 defining the exterior walls of the dishwasher 100. The frame 102 may be configured to interface with components exterior to the dishwasher 100 for installation, such as cabinets, countertops, floors, etc. The frame 102 may include a top, left side, right side, back, and bottom.

The tub 104 may define a hollow cavity or interior of the dishwasher for washing dishes. The tub 104 may define an open-face, or access opening 106 with walls at the top, left side, right side, back and bottom. A chassis (not individually labeled) may be arranged between the frame 102 and the tub 104 to maintain the tub 104 within the frame. The chassis may support the tub 104 and allow for maintaining space between the frame 102 and the tub 104.

A door assembly 110 may be arranged at a front of the dishwasher 100. The door assembly 110 may be attached to the dishwasher at the bottom front edge of the frame 102 and may be hinged thereat to move between open and closed positions. In the closed position, the door assembly 110 may seal the tub 104 at the access opening 106. In the open position, the cavity may be accessible via the access opening. In another example, the door assembly 110 may operate as a drawer that can be slidably extended outward from the front of the dishwasher 100 to move into the open position, and slidably retracted back into the dishwasher 100 to the closed position to seal the tub 104.

The tub 104 may house at least one dish rack. In the example shown in FIG. 1, the dishwasher 100 includes a first dish rack 122 and a second dish rack 124. It should be noted that while two dish racks are shown, this is only one example, and dishwashers 100 with more or fewer dish racks are possible. For instance, a dishwasher 100 may include a single rack or three or more racks.

Regardless of quantity or arrangement, the dish racks 122, 124 may be designed to hold the kitchen equipment in place for cleaning by the dishwasher 100. In many examples the dish racks 122, 124 are wire frame racks that allow for the flow of liquid within the tub 104. Although racks 122, 124 made of plastic, other materials are possible. The dish racks 122, 124 may generally include tines or other projections to allow the kitchen equipment to be washed to be held in a spaced apart relationship, such that the washing liquid and rinsing liquid can be projected onto the exposed kitchen equipment surfaces for cleaning these surfaces.

The racks are generally adapted to move between a retracted wash position within the tub 104 and an extended position outside the tub 104 for loading and unloading of the kitchen equipment to be washed. The racks typically include wheels or rollers for rolling movement along tracks or guides to the retracted and extended positions. In the illustrated example, the first rack 122 includes rollers or wheels that cooperate with a first track rail 132 formed at the bottom wall of the tub 104. A door track 111 may be arranged on the dishwasher door of the door assembly 110 as shown to allow the first rack to be rolled into an extended position when the door of the door assembly 110 is open. The second rack 124 is generally mounted within the tub 104 along a pair of second support rails 134 that cooperate with rollers associated with the side walls of the tub 104. Alternatively, the second rack 124 may be connected to a telescoping rail that allows the second rack to be extended out of the tub area when the door of the door assembly 110 is open. Thus, as shown the first and second racks 122, 124 may be movable along their respective track rails 132, 134 to allow the respective racks 122, 124 to be slidable in and out of the access opening 106. A third rack or tray 126 may also be arranged on and above one or more of the racks 122, 124. In the illustrated example, the third rack 126 is arranged above the second rack 124, but other configurations are possible, such as a single rack with a tray, or multiple racks each with a third rack 126, or one rack with multiple trays. As with the dish racks 122, 124, the third rack 126 is configured to receive kitchen equipment for washing. In one non-limiting example, the third rack 126 may be designed to hold kitchen equipment such as cutlery or knives that, due to their dimensions, are more difficult to hold in a fixed spaced apart arrangement within the dish racks 122, 124 themselves.

The dishwasher 100 may also include a spray system for spraying liquid within the tub 104 during a wash cycle. In an example wash cycle, washing liquid including soap may first be sprayed onto the kitchen equipment, and then once washed, rinsing liquid without soap may then be sprayed onto the kitchen equipment. The spray system may include various jets for providing the liquid onto the surfaces of dishes during the automated washing and rinsing operations. The spray system may include a bottom sprayer 142, middle sprayer 144, and a top sprayer (not shown). In some examples, one or more of the sprayers are positioned at fixed locations within the tub 104. In other examples, one or more of the sprayers may be rotating spray arms with various nozzles configured to spray water onto the dishes maintained on the rack for cleaning. For instance, water jets on the spray arm may be angled so the water sprays out of the spray arms at an angle (e.g., ~45 degrees off the vertical) thereby causing the spray arms to rotate due to the pressure of the exiting water.

During loading, a user may open the door assembly 110 into the open position, pull the racks 122, 124 from the tub 104, and load the kitchen equipment onto the racks 122, 124. Once completed, the user may push the racks back into the tub 104, move the door assembly 110 back to the closed position, and initiate the wash cycle. Once the wash cycle has been completed, the user may again open the door assembly 110 to remove the cleaned kitchen equipment from the racks.

Before the user opens the door assembly to remove the cleaned kitchen equipment, the dishwasher undergoes a dry cycle after the wash cycle is complete. The dry cycle is implemented by a drying system 200, a portion of the drying system 200 is shown and described with reference to FIGS. 2-7. The drying system 200 of the dishwasher 100 promotes water evaporation from the kitchen equipment (or, interchangeably, the load) positioned on the racks 122, 124 after the wash cycle has concluded, and prevents humid air from condensing back onto the load. The evaporation aspect of the drying system can be achieved by either heating the load with hot water in the final rinse phase of the wash cycle, or by heating the load and air with an internal or external heater (not shown) during the drying cycle. In certain embodiments described herein, the drying system may include components to heat the load and air with an internal or external heater during the drying phase. The load and air heating can be achieved in a variety of ways, for example, by condensing the humidity onto the tub walls for draining; removing humid air by venting via natural convection (e.g., a door opening system); forcing the humid air out of the system via a fan; or absorbing the humidity from the air in the tub with an adsorbent, or desiccant, material. As will be described below, an adsorbent material is described according to various embodiments for removing humidity from air to facilitate drying during the dry cycle.

According to one or more example embodiments, the drying system for the dishwasher 100 includes a drying system 200 with an adsorbent material for drying humid air from the dishwasher tub. The drying system 200 facilitates the drying performance and improves the energy efficiency of the dishwasher 100. Various embodiments of the drying system 200 will be shared with reference to the Figures. Generally, the drying system 200, 300 of FIGS. 2-3 do not require separate heating of the adsorbent material for regeneration. With reference to the figures like numerals are used to designate like structure throughout the drawings.

According to one or more example embodiments, the drying system 200, 300 for the dishwasher 100 includes an adsorbent component 260 comprising a water harvesting nanomaterial to improve the drying performance and energy efficiency of the dishwasher. The water harvesting nanomaterial is composed of a sponge-like regenerative nanomaterial. The nanomaterial may be a reactive oxygen species (ROS) based on powder or non-woven type adsorbent material, forming a sponge-like matrix for adsorbing water in pores of the nanomaterial. Upon heating of the adsorbent material, the adsorbed moisture is released from the pores for draining. Details of the adsorbent material in the drying system 200, 300 will be described below.

Figure 2:
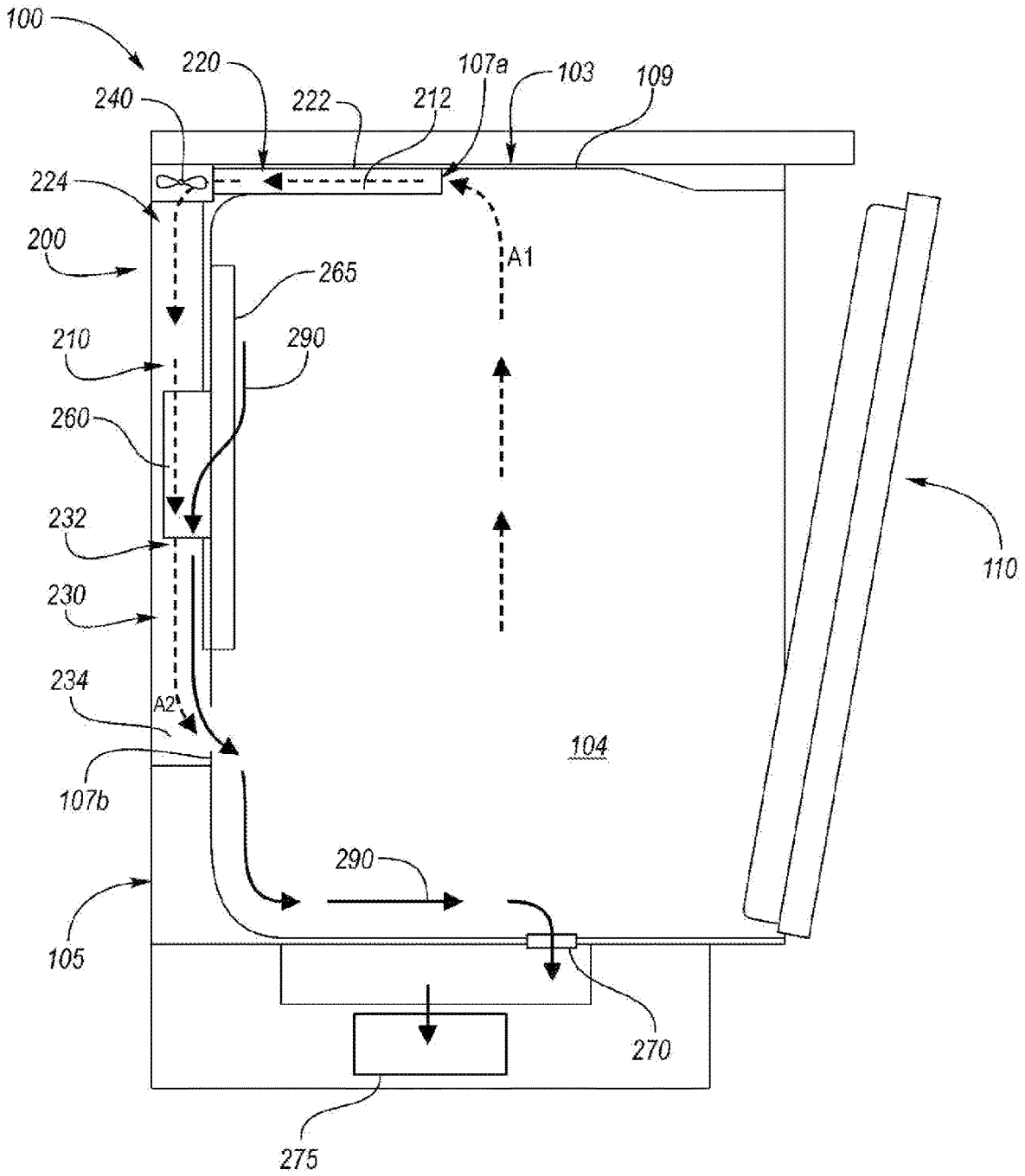
FIG. 2 is a schematic side view of a drying system of a dishwasher, according to an embodiment.

Referring to FIG. 2, the drying system 200 is shown, according to an example. Referring to FIG. 2, the exterior of the tub 104 of the dishwasher 100 is shown with a drying system 200, according to an embodiment. The dishwasher 100 is schematically shown without the frame 102 with only the relevant components of the drying system 200 shown, which is not intended to be limiting, as the dishwasher 100 includes other components and features for operation that have been removed to more clearly show the drying system 200. As such, an external surface 103 of the tub 104 of the dishwasher 100 is shown in FIG. 2 with the drying system 200 positioned on the external surface 103, and more specifically, on at least a portion of the tub side wall 105 of the tub 104. The drying system 200 has an air circuit 210 formed by an inlet conduit 220 and an outlet conduit 230. The tub side wall 105 may define one or more tub outlets 107*a* fluidly connecting the inlet conduit 220, and one or more tub inlets 107*b* for fluidly connecting the outlet conduit 230, to allow airflow 212 to flow into and out of the air circuit 210. The cross-section of each conduit 320, 330 may be shaped according to the contours of the external surface 103 of the tub 104. Although shown in the Figures as spanning a top surface 109 and tub side wall 105, the air circuit 210 may cover any suitable number of surfaces of the tub 104, or a single surface of the tub 104, and the depiction of the position of the air circuit 210 is not intended to be limiting.

The air circuit 210 further includes a fan 240 disposed therein. Generally, the fan 240 may be positioned anywhere along the air circuit 210 to draw air A1 into the air circuit 210 and flow dried air A2 out of the air circuit 210. Although a single fan 240 is shown generally vertically aligned with the horizontally extending portion of the air inlet conduit 220, multiple fans 240 may be positioned throughout the air circuit 210 as based on various designs and desired airflow through the drying system 200, and the depiction of a single fan 240 is not intended to be limiting. Moreover, the fan 240, in certain embodiments, may be positioned closer to the tub outlet 107*a* or closer to the tub inlet 107*b*, or at either end of the inlet conduit 220 or outlet conduit 230, and the position at the vertical top of the vertical section of the air circuit 210 is an example of where the fan 240 may be located in one embodiment, and is not intended to restrict the position of the fan 240 in other embodiments.

In the embodiment shown in FIG. 2, the inlet conduit 220 has an inlet upstream side 222 defined at the outlet 107*a*, and an inlet downstream side 224 defined beginning at the fan 240. The outlet conduit 230 has an outlet upstream side 232 defined at the adsorbent material 260, and an outlet downstream side 234 at the tub inlet 107*b*. The drying system 200 further includes any suitable mechanism (e.g., a valve or other seal) that blocks airflow 212 through both the inlet conduit 220 and the outlet conduit 230, respectively. The mechanism for blocking airflow may be activated by an actuator (not shown) (e.g., a motor, linear actuator, such as a wax actuator, solenoid, or similar suitable actuator) based on the cycle phase, providing a barrier to the airflow 212 from moving downstream through the air circuit 210 during the wash cycle, and allowing airflow 212 therethrough during the dry cycle.

As discussed above, the drying system 200 further includes an adsorbent component 260 positioned in the air circuit 210 downstream of the fan 240 between the inlet conduit 220 and the outlet conduit 230. The positioning of the adsorbent component 260 may be based on optimizing the latent heat in the dishwasher reaching the adsorbent component 260 for regenerating the adsorbent component 260. For example, the adsorbent component 260 may be positioned against the tub 104 to allow for heat from the interior of the tub 104 to conduct through the tub side wall 105 and convectively transfer within the air circuit 210 to the adsorbent component 260 to facilitate regeneration (i.e., release moisture in the form of water from) of the adsorbent material during the wash cycle, such that water from the adsorbent component 260 can be released and expelled via a drain 270 to the sump 275. In certain embodiments, based on the air circuit 210 shape and the position of the air circuit 210 on the tub side wall 105, the water (shown by arrows 290) from the adsorbent component 260 can be released and drained via gravity to the tub inlet 107*b* via the outlet conduit 230, respectively, to be released into the tub 104 and to the sump 275 at the end of the wash cycle (not shown). In other embodiments, as shown in FIG. 2, the moisture may be released directly into the tub 104 via an adsorbent material drain 265, separate from the air circuit 210, as shown in by arrows 290.

The adsorbent component 260 includes an adsorbent material that facilitates drying of the humid airflow 212 through the air circuit 210 of the drying system 200. The adsorbent material may be any suitable adsorbent material, such as, but not limited to a sorbent nanomaterial. The nanomaterial may be a sponge-like nanomaterial, or other suitable nanomaterial capable of regeneration and reducing the energy burden required to absorb and desorb water vapor from the airflow 212 through the drying system 200. In certain embodiments, the water harvesting nanomaterial is composed of a sponge-like regenerative nanomaterial. The nanomaterial may be a reactive oxygen species (ROS) based on powder or non-woven type adsorbent material, forming a sponge-like matrix for adsorbing water in pores of the nanomaterial. In one or more embodiments, the average pore size of the adsorbent material may be 5 nm to 100 nm, in other embodiments, 5 nm to 75 nm, and in yet other embodiments, 5 nm to 50 nm. In at least one embodiment, the water harvesting nanomaterial can hold up to 500 ml of water therein, in other embodiments, the water harvesting nanomaterial can hold 100 ml to 400 ml of water therein, and in yet other embodiments, the water harvesting nanomaterial can hold 150 to 350 ml of water therein. In certain other embodiments, the water harvesting nanomaterial can hold up to 300 ml of water therein. In one or more embodiments, the adsorbent material 260 reduces the energy burden required to absorb and desorb water vapor from the closed compartment of dishwashers, as compared with conventional adsorbent materials, thus allowing energy-efficient humidity management, enabling more efficient desiccant operation, and for allowing a new class of hybrid atmospheric water extraction materials because not only is the regeneration temperature low, but the adsorbent material 260 has greater adsorption of water per unit mass of adsorbent material in low humidity environments (e.g. as low as 40% relative humidity) when compared with conventional adsorbent materials at similar humidity levels. Moreover, at the operating temperature of the dishwasher dry cycle, the adsorption potential for water per unit mass of adsorbent material is also higher than that of conventional adsorbent materials. This efficiency is due to the nanomaterial construction of the reactive oxygen species having superior kinetics, which outperform compared to conventional sorbent materials.

Thus, the adsorbent material within the adsorbent component 260 provides energy-efficient humidity management, enable more efficient desiccant operation, and allows for atmospheric water extraction designs to be implemented. The nanomaterial adsorbents function like traditional desiccants, but use less energy to regenerate (i.e., eject their water vapor load) at a much lower temperature than traditional desiccants. For example, the regeneration temperature of the adsorbent material in certain embodiments may be 30 to 65° C. in some embodiments, 35 to 63° C. in other embodiments, and 40 to 60° C. in yet other embodiments, whereas in conventional desiccants, the regeneration temperature may be up to 200° C., and upwards of 65° C. The adsorbent material 260 may be capable of storing up to 300 mL of water, which can be released upon regeneration for draining. The released water increases the amount of water drained from the system by the amount stored in the water harvesting nanomaterial. The lower regeneration requirements of the adsorbent material results in improved energy-efficiency and lower temperature exhaust as external heaters are not needed in the drying system 200, and the dry air can be circulated back into the tub 104 for additional drying and moisture extraction. As such, the adsorbent component 260 may have a regeneration temperature of 30 to 65° C., which can be reached via latent heat entering the drying system 200 (e.g., from the interior of the tub 104 during a wash cycle via conductive heat transfer through the wall). As such, the adsorbent material is heated via heat from the dishwasher 100, without any additional heating components for regenerating the adsorbent material, and dry air can be circulated back into the tub 104 via the outlet conduit 230. However, in some embodiments, a low energy heating mechanism may be used to heat the adsorbent component 260.

Referring again to FIG. 2, during the drying cycle, the airflow 212 enters the air circuit 210 as hot humid airflow A1 from the tub 104 from tub outlet 107*a*, flowing into the inlet conduit 220 via being drawn in by the fan 240. The airflow 212 passes through the adsorbent component 260 such that moisture is removed from the airflow 212, forming dry air flow A2 in the outlet conduit 230 to be returned to the tub 104 via tub inlet 107*b*. The adsorbent material of the adsorbent component 260 is then regenerated during the following wash cycle when the temperature increases inside the tub 104 for heat transfer to the adsorbent component 260 such that water is drained from the adsorbent component 260 prior to the drying cycle. Although not shown, separate heating mechanisms may be included to facilitate regeneration of the adsorbent material 260. However, the selection of the adsorbent material 260 of the present drying system 200 is based on sufficient regeneration characteristics such that additional heating units are not required for regeneration.

In one or more embodiments, the drying system 200 includes the adsorbent material drain 265 for draining water from the regenerated adsorbent (as shown in FIG. 2), or the water can be drained via the outlet conduit 230. In other embodiments, the drain may be positioned elsewhere in the drying system 200 and configured to remove the water formed during regeneration of the adsorbent from the drying system either via the tub to the tub drain 270 or directly to the sump 275. For example, as shown in FIG. 2, the adsorbent material drain 265 may be incorporated adjacent to the adsorbent component 260 such that the water is removed upon regeneration and drained into the tub 104. However, the water may be drained at any suitable point during the wash and/or dry cycles via the drain as based on its position within the drying system. In embodiments where the drain 265 is incorporated adjacent to the adsorbent component 260, the water may be drained during regeneration during the following wash cycle into the tub. In other embodiments, for example where the water is drained via the outlet conduit 230, the drain may flow the water out from the drying system directly to an outlet, where it may, in certain embodiments, join water expelled from the tub.

Figure 3:
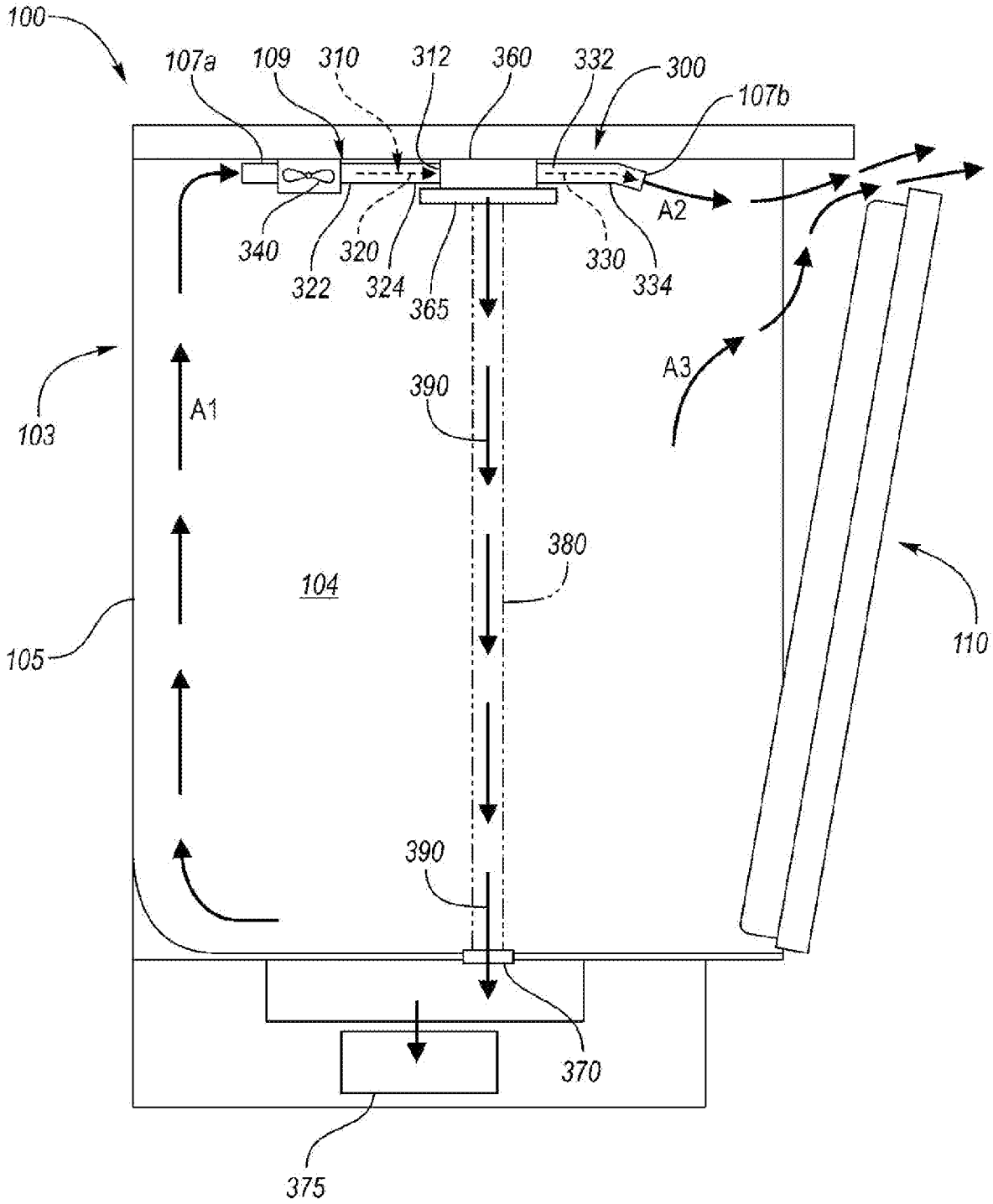
FIG. 3 is a schematic side view of a drying system of a dishwasher, according to another embodiment.

Although FIG. 2 shows a generally closed-loop system for drying system 200, FIG. 3 shows an open system as drying system 300, according to another embodiment.

Referring to FIG. 3, the drying system 300 is shown, according to another example. Referring to FIG. 3, the exterior of the tub 104 of the dishwasher 100 is shown with a drying system 300, according to an embodiment. The dishwasher 100 is schematically shown without the frame 102 with only the relevant components of the drying system 300 shown, which is not intended to be limiting, as the dishwasher 100 includes other components and features for operation that have been removed to more clearly show the drying system 300. As such, an external surface 103 of the tub 104 of the dishwasher 100 is shown in FIG. 3 with the drying system 300 positioned on the external surface 103, and more specifically, on at least a portion of the top surface 109 of the tub 104. The drying system 300 has an air circuit 310 formed by an inlet conduit 320 and an outlet conduit 330. The tub top wall 109 may define one or more tub outlets 107*a* fluidly connecting the inlet conduit 320, and one or more tub inlets 107*b* for fluidly connecting the outlet conduit 330, to allow airflow 312 to flow into and out of the air circuit 310. The cross-section of each conduit 320, 330 may be shaped according to the contours of the external surface 103 of the tub 104. Although shown in the Figures as spanning a top surface 109, the air circuit 310 may cover any suitable number of surfaces of the tub 104, or a single surface of the tub 104, and the depiction of the position of the air circuit 310 is not intended to be limiting.

The air circuit 310 is further routed such that airflow 312 exits the dishwasher 100 when the door assembly 110 is open. As such, the outlet conduit 330 is exposed to the external environment upon opening of the door assembly 110. The air circuit 310 may further include a fan 340 disposed therein at any suitable location along the air circuit 310 to draw air A1 into the air circuit 310 and flow dried air A2 out of the air circuit 310. Although a single fan is shown schematically within the air circuit 310, multiple fans 340 may be positioned throughout the air circuit 310 as based on various designs and desired airflow through the drying system 300, and the depiction of a single fan 340 is not intended to be limiting. Moreover, the fan 340, in certain embodiments, may be positioned closer to the tub outlet 107*a* or closer to the tub inlet 107*b*, or at either end of the inlet conduit 320 or outlet conduit 330, and the depiction of the fan location is not intended to restrict the position of the fan 340 in other embodiments.

In the embodiment shown in FIG. 3, the inlet conduit 320 has an inlet upstream side 322 defined at the outlet 107*a*, and an inlet downstream side 324 defined beginning at the fan 340 and ending at the adsorbent component 360 The outlet conduit 330 has an outlet upstream side 332 defined beginning at the adsorbent component 360, and an outlet downstream side 334 at the tub inlet 107*b*. The drying system 300 further includes any suitable mechanism (e.g., a valve or other seal) that blocks airflow 312 into the air circuit 310. The mechanism for blocking airflow may be activated by an actuator (not shown) (e.g., a motor, linear actuator, such as a wax actuator, solenoid, or similar suitable actuator) based on the cycle phase, providing a barrier to the airflow 312 from moving downstream through the air circuit 210 during the wash cycle, and allowing airflow 312 into the air circuit 310 during the dry cycle.

As discussed above, the drying system 300 further includes an adsorbent component 360 positioned in the air circuit 310 downstream of the fan 340 between the inlet conduit 320 and the outlet conduit 330. The positioning of the adsorbent component 360 may be based on optimizing the latent heat in the dishwasher reaching the adsorbent component 360 for regenerating the adsorbent component 360. For example, the adsorbent component 360 may be positioned against the tub 104 to allow for heat from the interior of the tub 104 to conduct through the tub side wall 105 and convectively transfer within the air circuit 310 to the adsorbent component 360 to facilitate regeneration (i.e., release moisture in the form of water from) of the adsorbent material during the wash cycle, such that water from the adsorbent component 360 can be released into the tub 104 and out via a sump to the drain. In certain embodiments, based on the air circuit 310 shape and the position of the air circuit 310 on the tub side wall 105, the water (shown by arrows 390) from the adsorbent component 360 can be released and drained via gravity to be released into the tub 104 and to the sump at the end of the wash cycle, or via a hose or ducting (not shown) directly to the sump 375 or drain 365. In other embodiments, the moisture may be released directly into the tub 104 via an adsorbent material drain 365, separate from the air circuit 310, as shown in FIG. 3 by arrows 390.

The adsorbent material of the adsorbent component 360 may be a suitable adsorbent material as described with respect to the drying system 200. As such, the adsorbent component 360 may reach the regeneration temperature of 30 to 65° C. which is reached via latent heat entering the drying system 300 (e.g., from the interior of the tub 104 during a wash cycle via conductive heat transfer through the wall). As such, the adsorbent material is heated via heat from the dishwasher 100, without any additional heating components for regenerating the adsorbent material.

Referring again to FIG. 3, during the drying cycle, the airflow 312 enters the air circuit 310 as hot humid airflow A1 from the tub 104 from tub outlet 107*a*, flowing into the inlet conduit 320 via being drawn in by the fan 340. The airflow 312 passes through the adsorbent component 360 such that moisture is removed from the airflow 312, forming dry air flow A2 in the outlet conduit 230 to be returned to the tub 104 via tub inlet 107*b* to facilitate drying of a load in the dishwasher 100 for a first portion of the dry cycle. During a second portion of the dry cycle, after the first portion, the door assembly 110 may be opened to facilitate drying of the load. When the door is opened, the dry airflow A2 exits the tub 104 to the external environment, along with hot humid air A3 from the tub cavity that is not drawn in by the fan 340. In certain embodiments, during the second portion of the dry cycle, humid air may also flow out from the air circuit instead of dry airflow A2 or along with dry airflow A2 if the adsorbent material has been saturated to the adsorbed moisture capacity (for example, in some embodiments, up to 300 mL of water). The door assembly of the dishwasher may be opened during a second portion as based on an interior humidity of the tub exceeding a predefined threshold. In certain embodiments, the door assembly may be opened during the second portion based on a temperature of the tub being below a threshold temperature. The threshold temperature may be, in some embodiments, less than 50 degrees C. The adsorbent material of the adsorbent component 360 is then regenerated during the following wash cycle when the temperature increases inside the tub 104 for latent heat to be generated and conductively and/or convectively transferred to the adsorbent component 360 such that water is drained from the adsorbent component 360 prior to the drying cycle upon the adsorbent material reaching its critical regeneration temperature. Although not shown, separate low energy heating mechanisms may be included to facilitate regeneration of the adsorbent material 360. However, the selection of the adsorbent material 360 of the present drying system 300 is based on sufficient regeneration characteristics such that additional heating units are not required for regeneration.

In one or more embodiments, the drying system 300 drains water from regenerating the adsorbent component 360 via the adsorbent material drain 365. The water may be routed directly in the tub 104 to the tub drain 370 or to the sump 370 via a hose 380, or enter the tub via the outlet conduit 230 for draining to the drain 370 with water from the wash cycle in the tub 104 (as in FIG. 2). In other embodiments, the drain may be separate from the tub drain 370 and placed elsewhere in the drying system 300, with the separate drain being configured to remove the water formed during regeneration of the adsorbent from the drying system 300. Based on the routing of the water to the drain 370, the water may be drained at any suitable point during the wash and/or dry cycles. For example, when the water enters the tub 104 via outlet conduit 230 to tub inlet 107, the water is supplied to the tub 104 via the drain 365 prior to the dry cycle, such that it is drained with the wash water from the tub 104. In embodiments where the water from regeneration is supplied to the drain 370 or sump 375 via a separate hose 380, the water may drain during the wash or dry cycle to join water expelled from the tub 104.

According to one or more embodiments, a method of operating a dishwasher includes running a wash cycle to clean dishes loaded into a tub of the dishwasher, and initiating a dry cycle which supplies hot air to the tub to dry the dishes to form hot humid air. The method further includes upon initiating the dry cycle, unblocking airflow from entering an air circuit of the drying system, the air circuit housing an adsorbent component, and flowing the hot humid air into the air circuit to contact the adsorbent component to form a dry air stream to be supplied back to the tub during a first portion of the dry cycle. The method further includes, during a second portion of the dry cycle, after the first, opening a door assembly of the dishwasher to allow the dry air steam to exit the drying system to the external environment, along with hot humid air from the tub that is not drawn into the air circuit for drying. In certain embodiments, during the second portion of the dry cycle, humid air may also flow from the air circuit if the adsorbent material has been saturated to the adsorbed moisture capacity. The door assembly of the dishwasher may be opened during a second portion as based on an interior humidity of the tub exceeding a predefined threshold. In certain embodiments, the door assembly may be opened during the second portion based on a temperature of the tub being below a threshold temperature. The threshold temperature may be, in some embodiments, less than 50 degrees C.

During a subsequent wash cycle, the method includes regenerating the adsorbent component via latent heat generated during the wash cycle. The latent heat is transferred to the adsorbent component via conduction through at least one tub wall and/or convection within the air circuit expel water from the adsorbent component, with the water being drained from the drying system prior to a subsequent dry cycle (e.g., with the wash water at the end of the wash cycle).

According to one or more embodiments, a dishwasher includes a drying system having an adsorbent material which can be regenerated using latent heat generated within the dishwasher and dishwasher tub, without requiring additional heating components. The adsorbent material is conductively heated through the tub wall and/or via convective heat transferred to air within the air circuit housing the adsorbent material. Humid air is fed from the tub to the air circuit, and contacted with the adsorbent material to form a dry air stream to be returned to the tub or vented to the external environment. The adsorbent material is a water harvesting nanomaterial, such as a reactive oxygen species having a sponge-like nanostructure, that has a low regeneration temperature (e.g., 30 to 65 degrees C. in some examples, or about 40 to 50 degrees C. in further examples). Thus, the adsorbent material can create a lower temperature exhaust as high heat is not required for regeneration, while improving the drying performance and energy efficiency of the dishwasher.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. As used herein, the term "about" means that the amount or value in question may be the specific value designated or some other value in its neighborhood. Generally, the term "about" denoting a certain value is intended to denote a range within +/−5% of the value. As one example, the phrase "about 100" denotes a range of 100+/−5, i.e. the range from 95 to 105. Generally, when the term "about" is used, it can be expected that similar results or effects according to the invention can be obtained within a range of +/−5% of the indicated value.

It should also be appreciated that integer ranges (e.g., for measurements or dimensions) explicitly include all intervening integers. For example, the integer range 1-10 explicitly includes 1, 2, 3, 4, 5, 6, 7, 8, 9, and 10. Similarly, the range 1 to 100 includes 1, 2, 3, 4, . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

In the specific examples set forth herein, concentrations, temperature, and reaction conditions (e.g. pressure, pH, flow rates etc.) can be practiced with plus or minus 50 percent of the values of the examples indicated, rounded to or truncated to three significant figures. In a refinement, concentrations, temperature, and reaction conditions (e.g., pressure, pH, flow rates, etc.) can be practiced with plus or minus 30 percent of the values indicated rounded to three significant figures of the value provided in the examples. In another refinement, concentrations, temperature, and reaction conditions (e.g., pressure, pH, flow rates, etc.) can be practiced with plus or minus 10 percent of the values indicated rounded to three significant figures of the value provided in the examples.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

What is claimed is:

1. A dishwasher comprising:

a sprayer;

a housing having walls defining a tub with a tub outlet for humid air to flow out from the tub, and a tub inlet for dry air to flow into the tub; and a drying system including:

an air circuit positioned outside of an interior volume of the tub and adjacent to at least one side wall of the tub, the air circuit having an air inlet toward an upper end of the tub for flowing the humid air into the air circuit, and an air outlet connected to the tub inlet to flow dried air to the tub at a lower end of the tub, the air circuit defining a vertical airflow path adjacent to the at least one side wall between the upper end and the lower end, an adsorbent component disposed between the air inlet and the air outlet within the vertical airflow path and against the at least one side wall of the tub between the upper end and the lower end such that air flows downward over the adsorbent component within the vertical airflow path of the air circuit, the adsorbent component including a water harvesting nanomaterial for absorbing water from the humid air when the air flows downward over the adsorbent component and releasing water upon regeneration, and a valve operatively coupled to the air circuit, wherein, during a drying cycle, the air circuit draws humid air from the tub via the air inlet such that the adsorbent component absorbs moisture from the humid air to form a dry air stream through the vertical airflow path, and during a subsequent wash cycle, the valve operatively coupled to the air circuit is controlled to be closed and the air circuit is blocked from receiving air flow from the tub such that latent heat is transferred to the adsorbent component via conduction through the at least one side wall and convection within the vertical flow path of the air circuit, to regenerate the water harvesting nanomaterial.

2. The dishwasher of claim 1, wherein the water harvesting nanomaterial has an average pore size of 5 nm to 100 nm.

3. The dishwasher of claim 1, wherein the water harvesting nanomaterial has a regeneration temperature of 30 to 65 degrees C.

4. The dishwasher of claim 1, wherein during the drying cycle, the dry air stream is returned to the tub via the tub inlet.

5. The dishwasher of claim 1, wherein during the subsequent wash cycle, water released from the water harvesting nanomaterial during regeneration is drained from the air circuit into the tub for draining with wash water.

* * * * *